US005954294A

United States Patent [19]

Forsner

[11] Patent Number: 5,954,294

[45] Date of Patent: Sep. 21, 1999

[54] METHOD OF MANUFACTURING A COIL OF FLEXIBLE OBJECT AND CORE THEREFOR

[75] Inventor: Bo Forsner, Österskär, Sweden

[73] Assignee: Ulvator AB, Sweden

[21] Appl. No.: 09/101,199

[22] PCT Filed: Jan. 16, 1997

[86] PCT No.: PCT/SE97/00054

§ 371 Date: Sep. 15, 1998

§ 102(e) Date: Sep. 15, 1998

[87] PCT Pub. No.: WO97/26206

PCT Pub. Date: Jul. 24, 1997

[30] Foreign Application Priority Data

Jan. 19, 1996 [SE] Sweden ..... 9600198

[51] Int. Cl.[6] ..... B65H 75/20

[52] U.S. Cl. ..... 242/604; 242/601; 242/608; 53/399

[58] Field of Search ..... 53/399; 242/407.1, 242/604, 608, 608.6, 609, 118.61, 601

[56] References Cited

U.S. PATENT DOCUMENTS

| | | | |
|---|---|---|---|
| 2,667,257 | 1/1954 | Hurtado | 400/242 |
| 3,134,557 | 5/1964 | Cohen | 242/118.61 |
| 3,552,677 | 1/1971 | Hacker | 242/118.61 |
| 3,661,341 | 5/1972 | Eifrid . | |
| 3,817,475 | 6/1974 | Goldstein . | |
| 3,836,093 | 9/1974 | Mozina et al. . | |
| 4,620,676 | 11/1986 | Missalla | 242/604 |
| 5,400,567 | 3/1995 | Lindstrand | 53/399 |
| 5,575,437 | 11/1996 | Campbell | 242/608.6 |
| 5,660,354 | 8/1997 | Ripplinger | 242/608 |

FOREIGN PATENT DOCUMENTS

| | | |
|---|---|---|
| 0 320 751 | 6/1989 | European Pat. Off. . |
| 1404448 | 8/1975 | United Kingdom . |
| 2053848 | 2/1981 | United Kingdom . |
| WO 91/16261 | 10/1991 | WIPO . |

*Primary Examiner*—Donald P. Walsh
*Assistant Examiner*—Minh-Chau Pham
*Attorney, Agent, or Firm*—Nixon & Vanderhye P.C.

[57] ABSTRACT

A core of a rotatable unit for manufacturing a coil of a flexible object and enveloping the coil to form a parcel for delivery to a user of the object. According to the invention the core comprises a number of longitudinal support elements (3) and two flat end rings (1, 2) each with a central opening (6), an inner circular support surface (7) with predetermined radius, and recesses (8) arranged in connection with the support surface (7). The end portions (9, 10) of the support elements are in engagement with the recesses (8) to fix the end rings and support elements to each other. Furthermore, the inner sides (14) of the support elements (3) coincide with the support surfaces (7) of the end rings and the end surfaces (11, 12) with the outer sides (5) of the end rings. A method is also described for manufacturing said coil, commencing with assembling said core.

21 Claims, 10 Drawing Sheets

METHOD OF MANUFACTURING A COIL OF FLEXIBLE OBJECT AND CORE THEREFOR

CROSS-REFERENCE TO RELATED APPLICATION

This application is the U.S. national phase of International Application No. PCT/SE97/00054 filed Jan. 16, 1997.

BACKGROUND AND SUMMARY OF THE INVENTION

The present invention relates to a method of manufacturing a coil of a continuous, flexible object, in particular hosing, flexible tubing, rope and the like, and enveloping the coil to form a parcel for delivery to a user of the object, said object being coiled onto an axially open core to produce said coil, said method comprising the steps of:

a) bringing the core to be fixed by a tool so that it is firmly clamped between two parallel support rings of the tool and centered by a centering element in each support ring, whereby a rotatable unit is formed, b) attaching said object to said unit and bringing the unit to rotate in a coiling machine so that the object is wound to form said coil, and c) when the object has been cut, bringing a plurality of continuous straps to surround the core from the inside thereof, and the coil enclosing the core, without engagement with the support rings, after which the straps are tightened and secured to form said parcel. The invention also relates to a core of a rotatable unit for manufacturing a coil of a continuous flexible object, in particular hosing, flexible tubing, rope or the like, and enveloping the coil to form a parcel for delivery to a user of the object.

Such hosing and flexible tubing used, for instance, for laying fibre optic cable, is delivered in rolls, known as coils, where small quantities are concerned. The roll is free from core and wrapping and is held together by a number of straps. At the application site the roll is placed on a special device to enable the hosing to be rolled off when the straps have been cut, or the roll is placed on the ground, the straps cut and the hosing pulled out, which is relatively inconvenient. This technique is therefore limited to deliveries of shorter lengths of hosing.

Conventional wooden drums are used for delivery of particularly longer lengths of hosing and flexible tubing, e.g. lengths of 500–2000 meter. Since these hosing and tubing products require a relatively large radius to allow bending, wooden drums must be chosen that have cores with a diameter of about 1 meter and more, referring to the inner cylindrical part. The size of the wooden drum will therefore be necessarily considerable, entailing high costs for manufacture and handling of the wooden drum. When the hosing or flexible tubing is delivered on wooden drums at the use site, the wooden drum is mounted on special equipment for unwinding and pulling out the hosing or tubing. The wooden drum is often skew and the hosing or tubing is thus pulled off jerky so that the work takes longer. Furthermore, the empty wooden drum must be returned to be used for a new delivery of hosing or tubing. This increases the total handling costs and the repeated use of the wooden drum, entailing wear and rough treatment, may contribute to it becoming skew.

SE-9101042-1 describes a special system for handling continuous, flexible objects such as hosing or flexible tubing, said handling commencing with the manufacture of a coil of cable or cord and enveloping the coil to form a parcel for delivery to a user. The coil is obtained by the object being wound onto an axially open, cylindrical sleeve. Before coiling is performed, the sleeve is provided with two flat, outer protective rings having concentric support surfaces cooperating with opposite internal or external surfaces of the sleeve depending on which form of protective rings are used. The sleeve is then fixed by a tool which has two parallel support rings with centering elements facing each other so that the sleeve is clamped between the support rings and centered by their centering elements so that a rotatable unit is formed. The object is then attached to said unit and the unit is brought to rotate in a coiling machine so that the object is wound to form a coil. The finished coil is surrounded by a protective covering, after which binding bands are passed through the sleeve to enclose the coil and the protective rings, and tightened to form said parcel. The support rings are removed from the finished parcel to be used for manufacturing further coils. The finished parcel is delivered as it is to a work place, where another tool is mounted on the parcel to prepare for unwinding the object. The second tool also has two parallel support rings with centering elements facing each other. By clamping the parcel between the support rings and centering the parcel with the aid of their centering elements, a rotatable unit is obtained which can then be stored for free rotation about a horizontal or vertical axis of rotation in a special unwinding device. After cutting the straps and removing the protective covering, the object is exposed for unwinding.

When using the handling system described in the above-mentioned specification SE-9101042-1 for hosing and flexible tubing for fibre optic cable, for instance, it has been found that the parcel manufactured is relatively expensive and unnecessarily strong and thus has relatively high weight. A contributory reason for this is that, as mentioned earlier for wooden drums, a core is required, in this case a sleeve with a diameter of about 1 m and protective rings with a diameter of up to about 2.5 m.

The object of the invention is to eliminate the problems associated with the use of coils and wooden drums and improve the known advantageous handling system for continuous flexible objects so that products such as hosing and flexible tubing can be delivered in the form of parcels at a lower, acceptable cost, the products being sufficiently but not excessively strong, requiring less material and thereby having reduced weight.

The method according to the invention is characterized in that the end portions of a predetermined number of longitudinal support elements of equal length are brought into engagement with two flat, parallel end rings via corresponding recesses therein, located close to an inner, circular, concentric support surface which surrounds a central opening into which the recesses open, so that the end surfaces of the support elements coincide with the outer sides of the end rings, and the inner sides of the support elements coincide with the circular support surface to form said core, whereupon the centering elements of said support rings are inserted in said opening to actively press against the circular support surfaces and the inner sides of the support elements.

The core according to the invention is characterized in that it comprises a predetermined number of longitudinal support elements of equal length with end portions, parallel end surfaces and outer and inner sides; and two flat, parallel end rings each having a central opening, an inner circular concentric support surface which surrounds the central opening and has a predetermined radius, and a number of recesses corresponding to the number of support elements, which recesses are arranged in connection with the support surface and open towards the opening, the end portions of the support elements being in engagement with the recesses to keep the end rings parallel to each other and hold the support elements in axial position perpendicular to the end rings, the inner sides of the support elements being arranged to coincide with the support surfaces of the end rings and the end surfaces of the support elements with the outer sides of the end rings.

The invention will be described in more detail in the following with reference to the drawings.

DETAILED DESCRIPTION OF THE DRAWINGS

Figure 1:
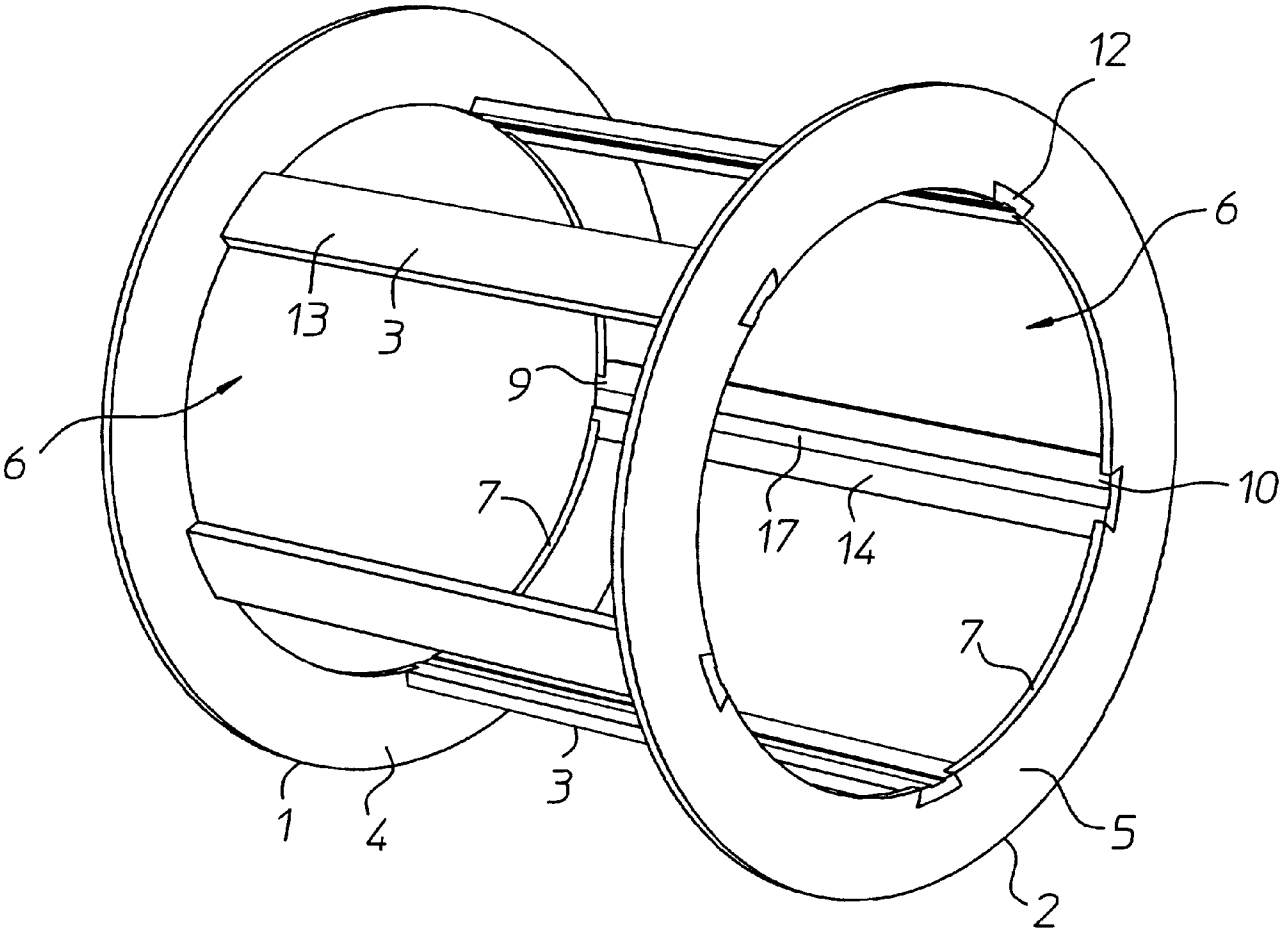
FIG. 1 is a perspective view of a finished core according to a first embodiment of the invention.
Figure 2:
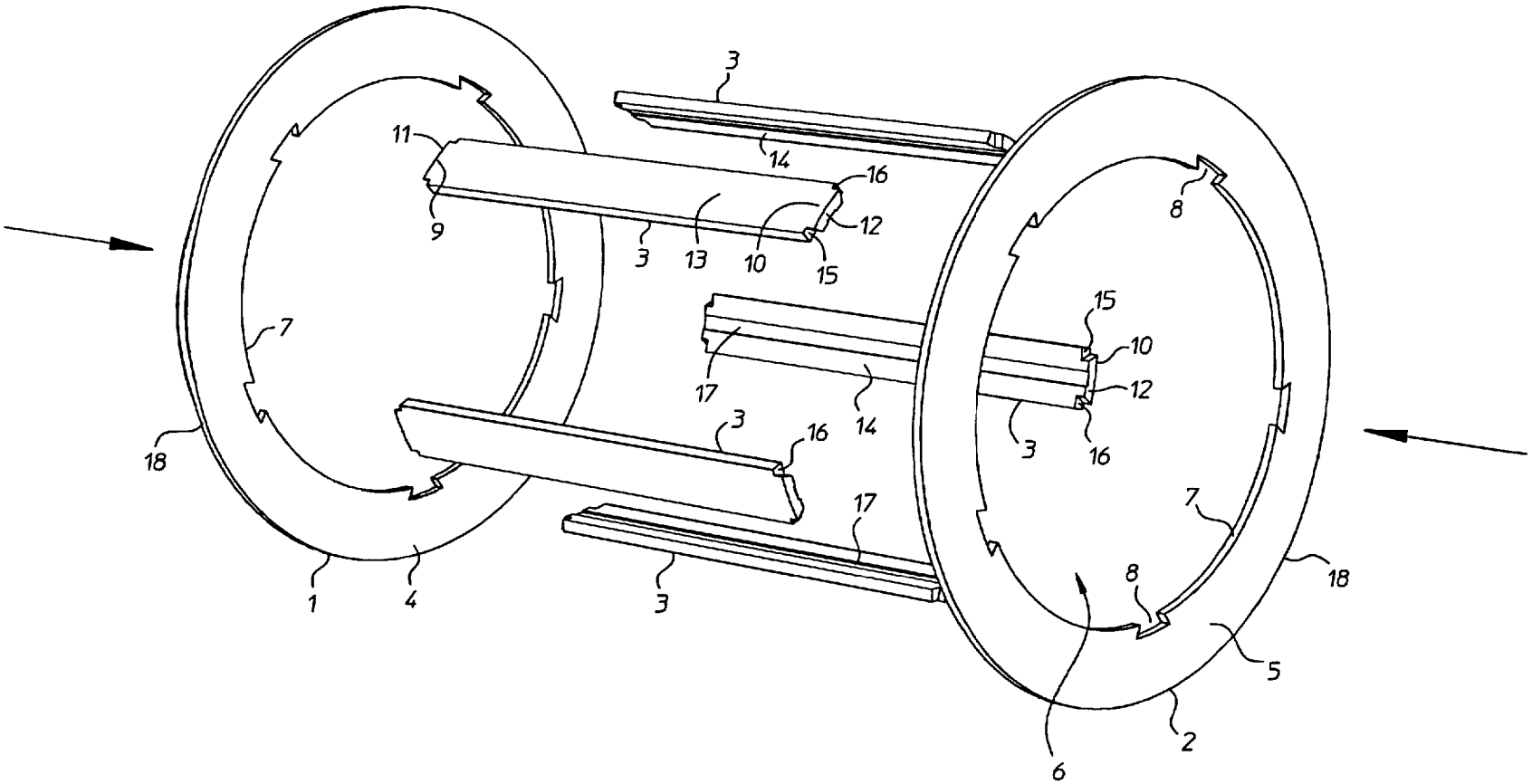
FIG. 2 is an exploded view of the core according to FIG. 1 and illustrates the position of the various parts when being assembled to form a finished core.

FIG. 1 shows a finished core whereas FIG. 2 illustrates assembly of the core according to the invention. The core consists of two flat, identical (equivalent), coaxial end rings 1, 2 and a predetermined number of longitudinal support elements 3, elements in the same core being the same length.

Each end ring 1, 2 has an inner side 4 and an outer side 5, as well as a central, circular opening 6. The end rings 1, 2 are designed with a functional, inner, concentric support surface 7 having a predetermined radius and surrounding said opening 6. In connection with the support surface 7 the end ring 1, 2 is provided with a predetermined number of recesses 8, axially throughgoing, and open radially inwardly towards the opening 6. The number of recesses 8 corresponds to the number of support elements 3. The length of the recesses, i.e. their extent in circumferential direction, increases from the support surface 7 in towards the end ring 1, 2, giving the recess 8 a dovetail shape. The distance between two adjacent recesses 8 is the same around the whole support surface 7.

The end rings 1, 2, like the support elements 3, are form-stable, i.e. they withstand the loads they are subjected to during winding and unwinding the hosing. The width of the end rings 1, 2, i.e. the radial distance between the inner periphery 7 and the outer periphery 18 is chosen sufficient to be able to secure the support elements 3 in all directions and to withstand radial strain. For this purpose the width of the end ring is at least about 50–100 mm, i.e. the difference between the outer and inner diameters is about 100–200 mm. Larger widths may be used if desired, but at the expense of increased material consumption and increased weight, two factors that should generally be avoided.

Each support element has two end portions 9, 10, two end surfaces 11, 12 facing away from each other, an outer side 13 and an inner side 14. The end portions 9, 10 of the support elements 3 are suited to the recesses 8 of the end rings 1, 2. The end surfaces 11, 12 of each support element facing away from each other are parallel with each other and with the end rings 1, 2. In the preferred embodiment shown the support elements 3 are wider than the length (in circumferential direction) of the recesses 8 and the end portions 9, 10 are thus shaped as tenons with the same cross-sectional shape as the shape of a recess 8 seen from the side. Each tenon 9, 10, which is thus dovetail shaped, has a length in axial extension that is equal to the thickness of the end rings 1, 2. Shaping the end portions as centrally located tenons 9, 10 produces functional support surfaces 15, 16 on each side of every tenon, which are arranged to abut the inner side 4 of the end ring 1, 2 and form distinct stops therefor.

During assembly, the tenons 11, 12 are inserted into the opposing recesses 8 in the direction to the inner sides 4 of the end rings 1, 2 so that a dovetailed joint without clearance is formed. The engagement obtained through the dovetailing prevents the support elements 3 from falling out of the recesses 8 in radial direction. The inner support surfaces 15, 16 of the support elements cooperate with the end rings 1, 2 so that these are fixed in parallel position in relation to each other and with the smallest possible distance between them. In order to obtain a manageable core in the initial operations described below, so that the support elements 3 are retained in the recesses 8 seen in axial direction outwards, it is sufficient for the opposing side surfaces of the tenons 9, 10 and the recesses 8 to provide friction engagement with each other. It is thus an advantage of the invention that neither nails nor glue need be used to achieve functional joints.

Each support element 3 is provided on its inner side with a central groove 17 extending between the end surfaces 11, 12, and having a predetermined cross section.

Figure 3:
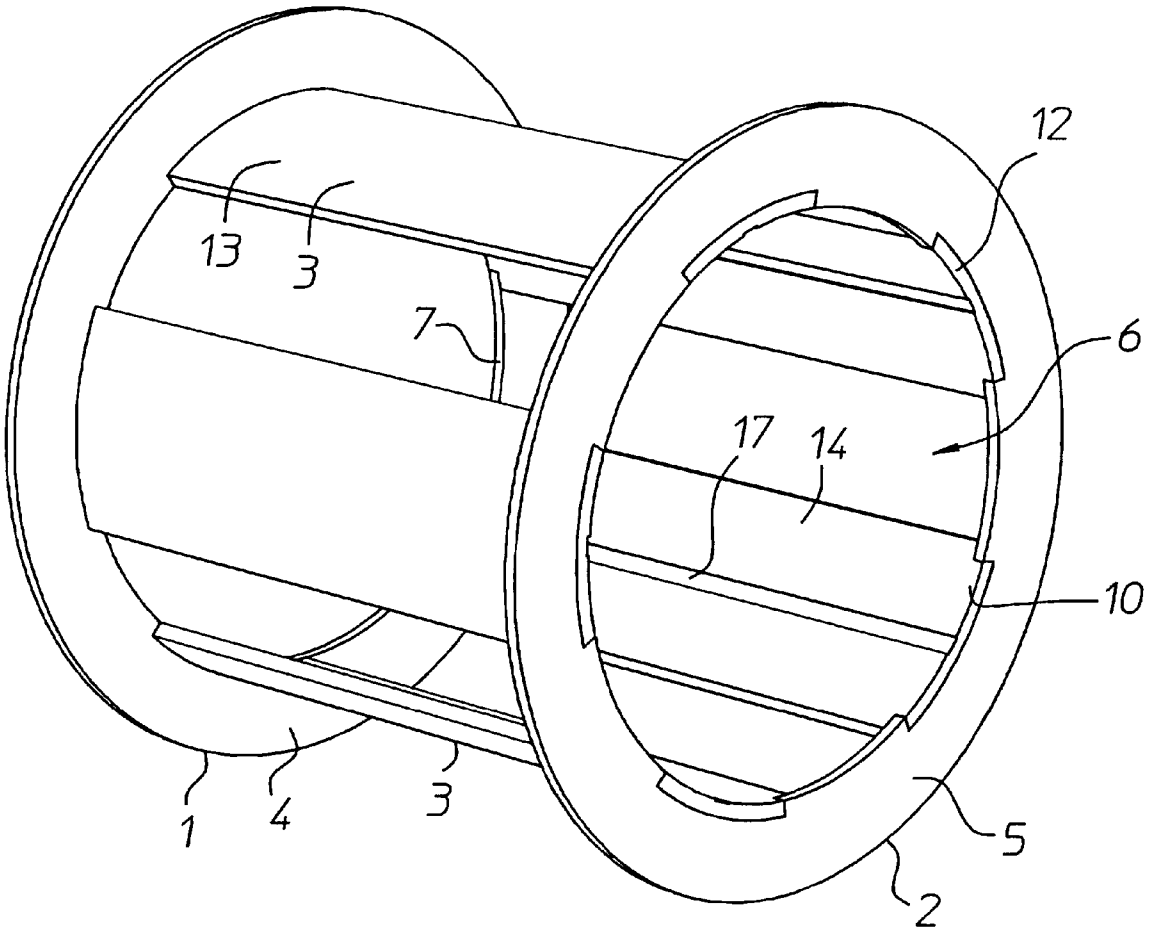
FIGS. 3 and 4 are equivalent perspective and exploded views to FIGS. 1 and 2 for a core and its parts according to a second embodiment of the invention.
Figure 4:
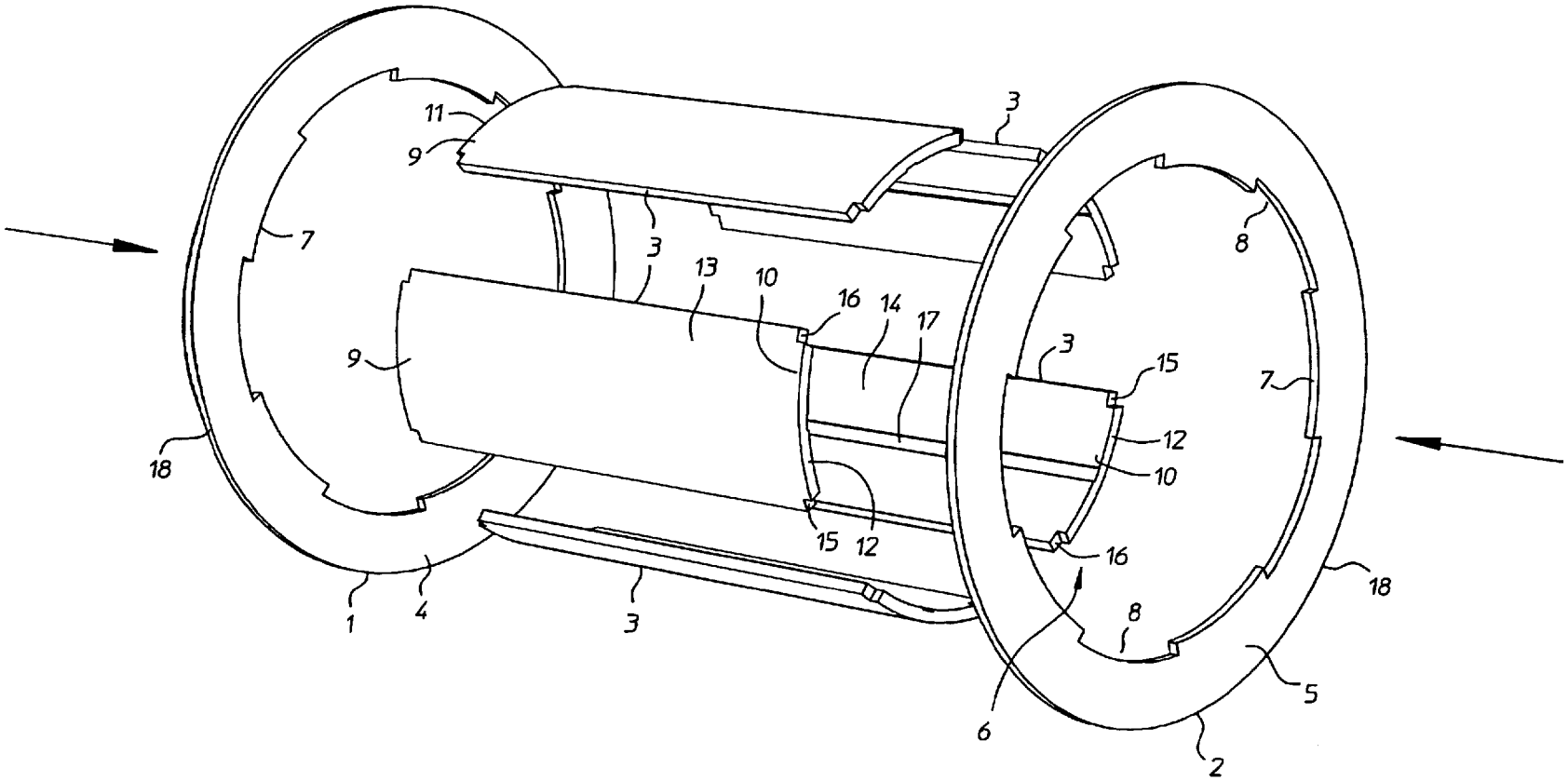

FIG. 3 shows a core whereas FIG. 4 illustrates the manufacture of a core according to the embodiment described above, the only difference being that the support elements 3 are considerably wider, as well as the recesses 8 being considerably longer.

The width of the support elements 3 and their number are chosen depending, amongst other things, on the stiffness and temperature of the hosing at manufacture and the subsequent coiling.

Figure 5:
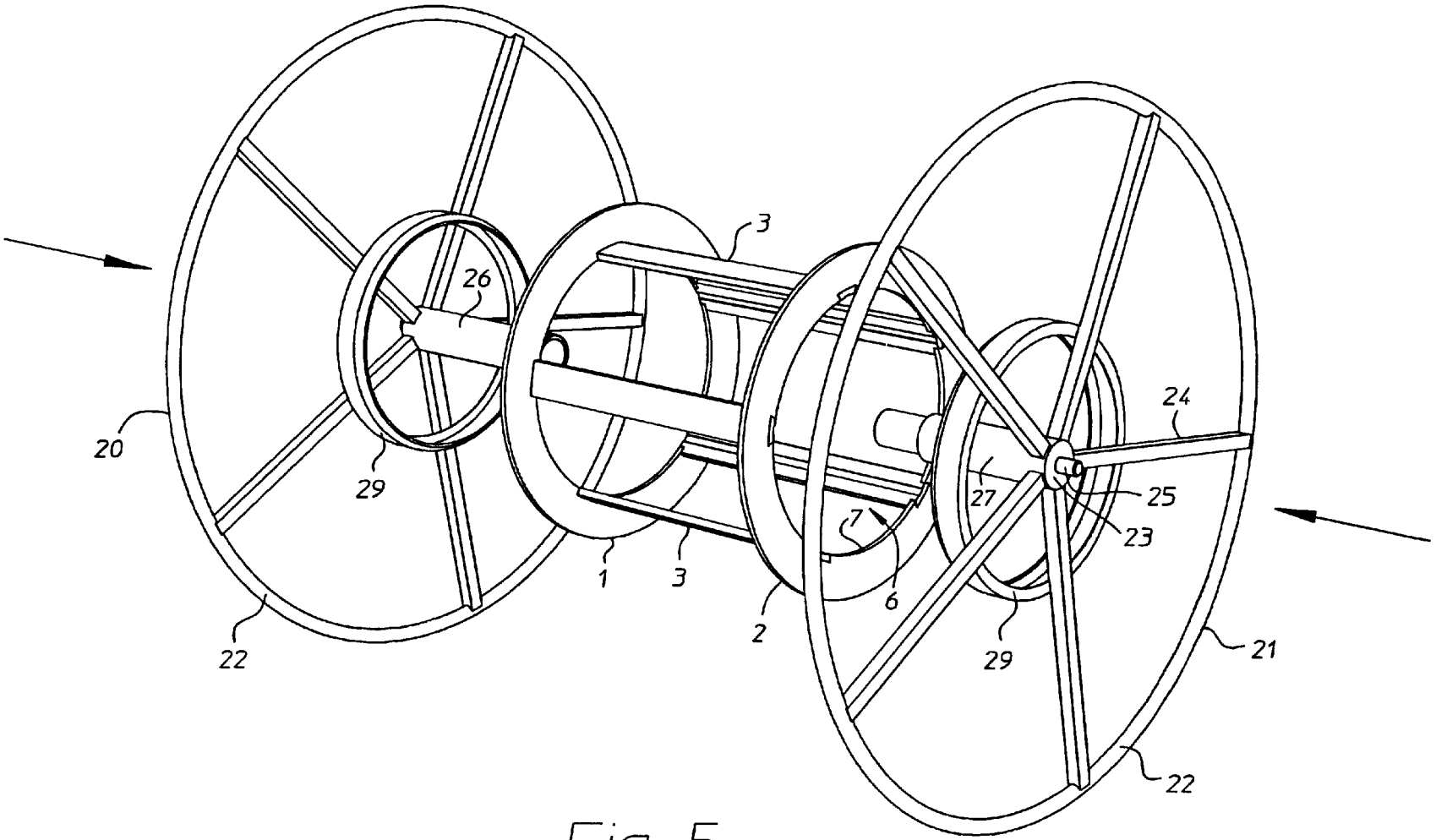
FIGS. 5–10 illustrate the various steps in order to provide first a rotatable unit, then a coil and finally a finished parcel.
Figure 6:
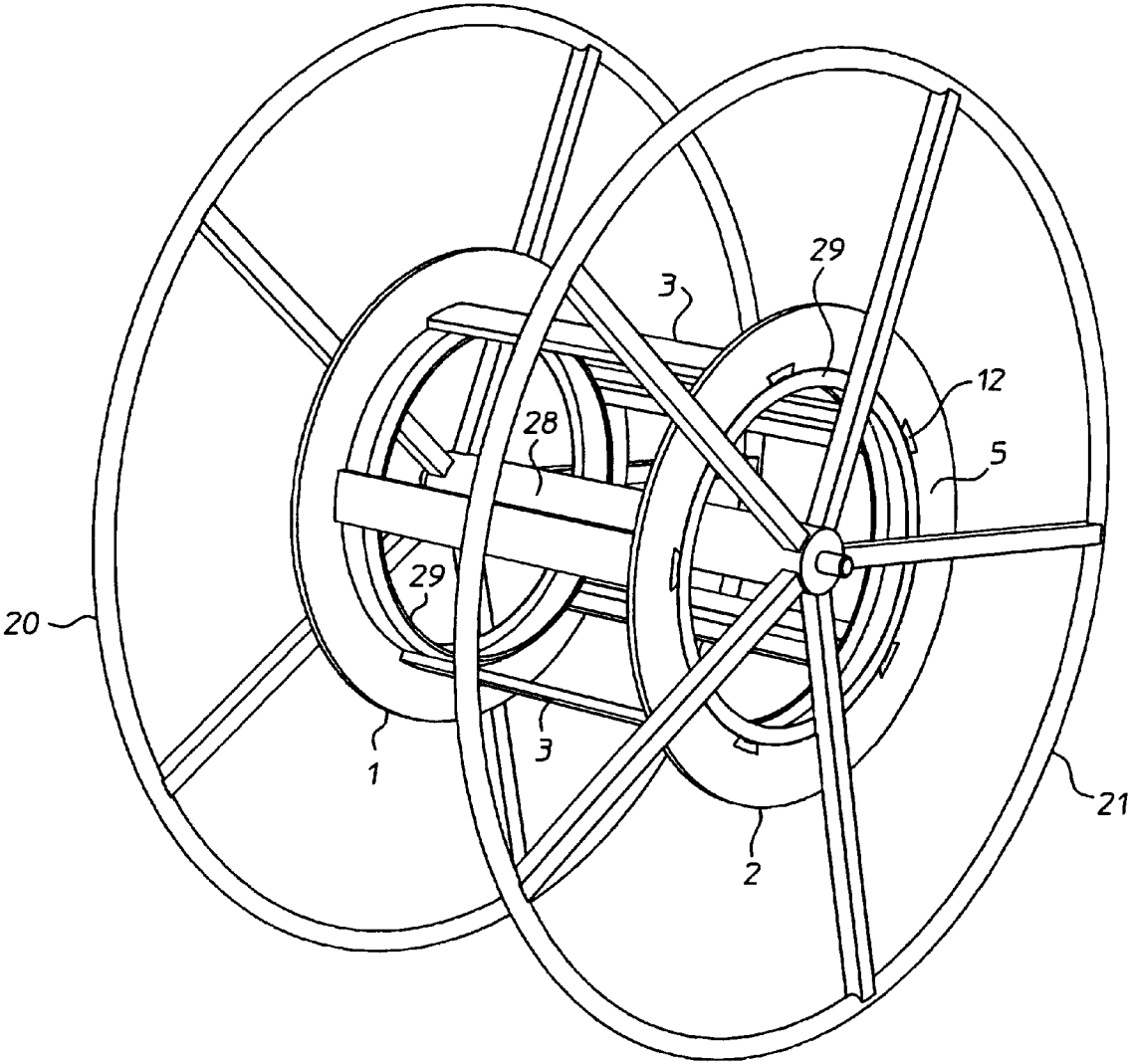
Figure 7:
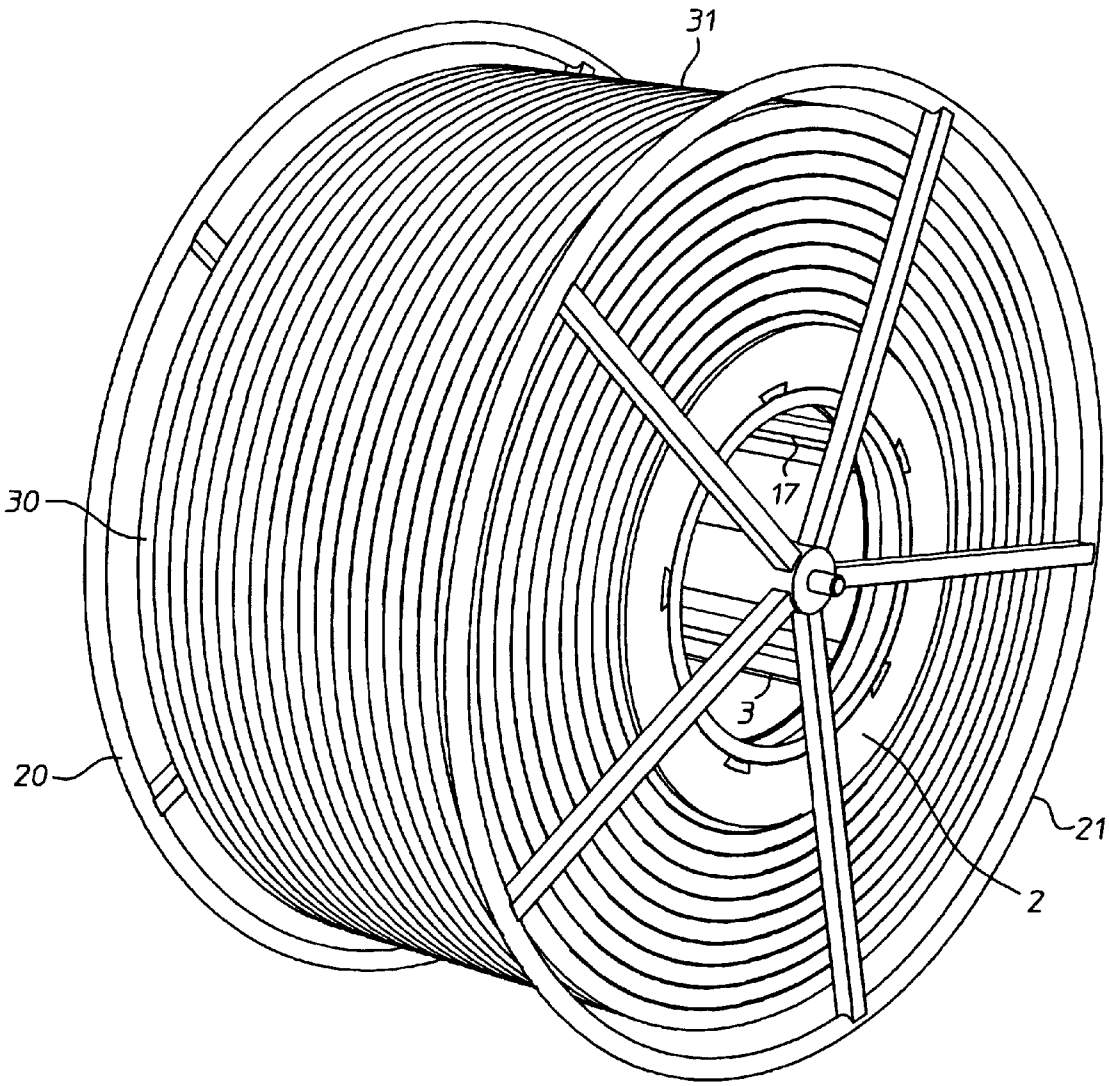
Figure 8:
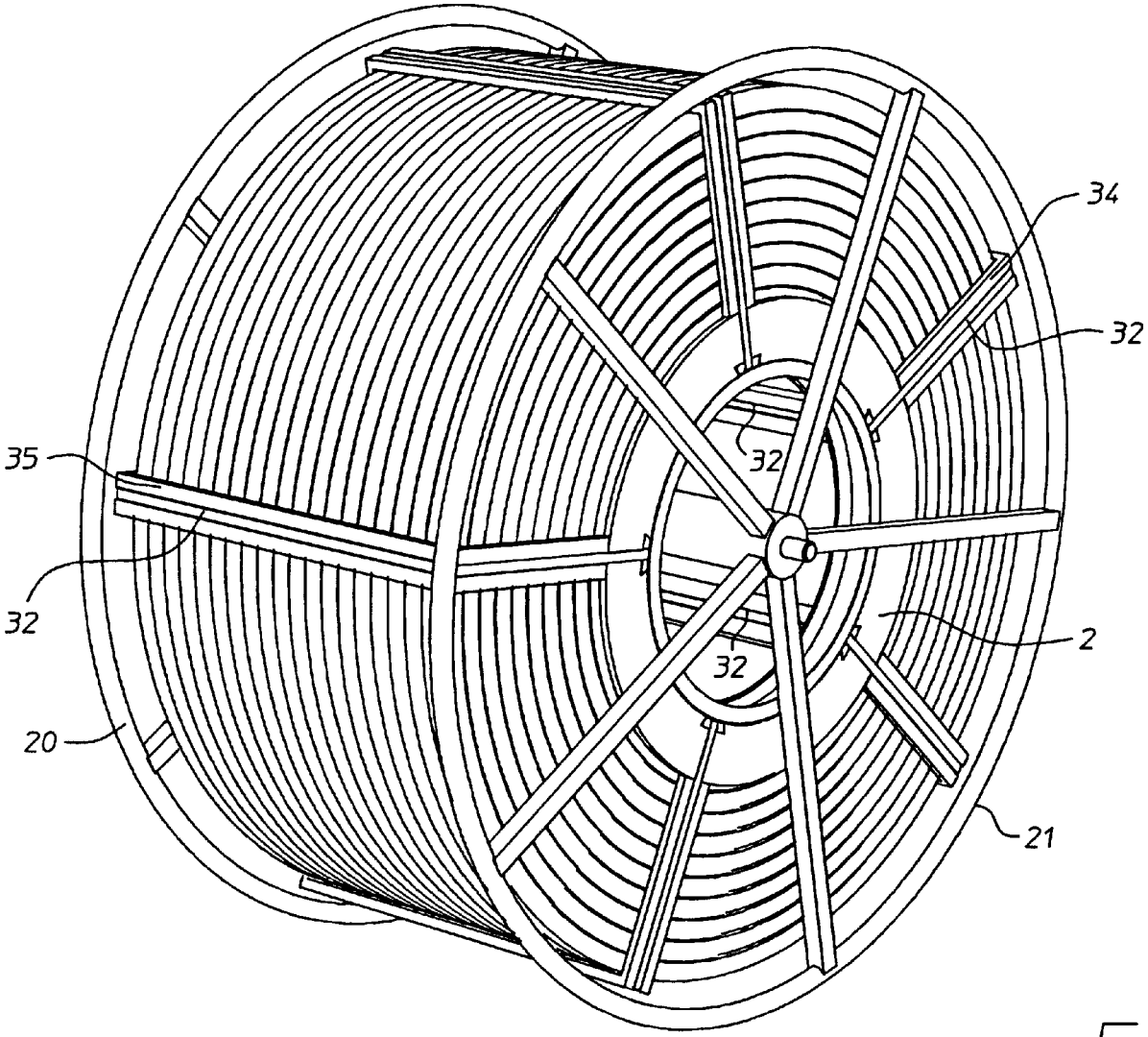
Figure 9:
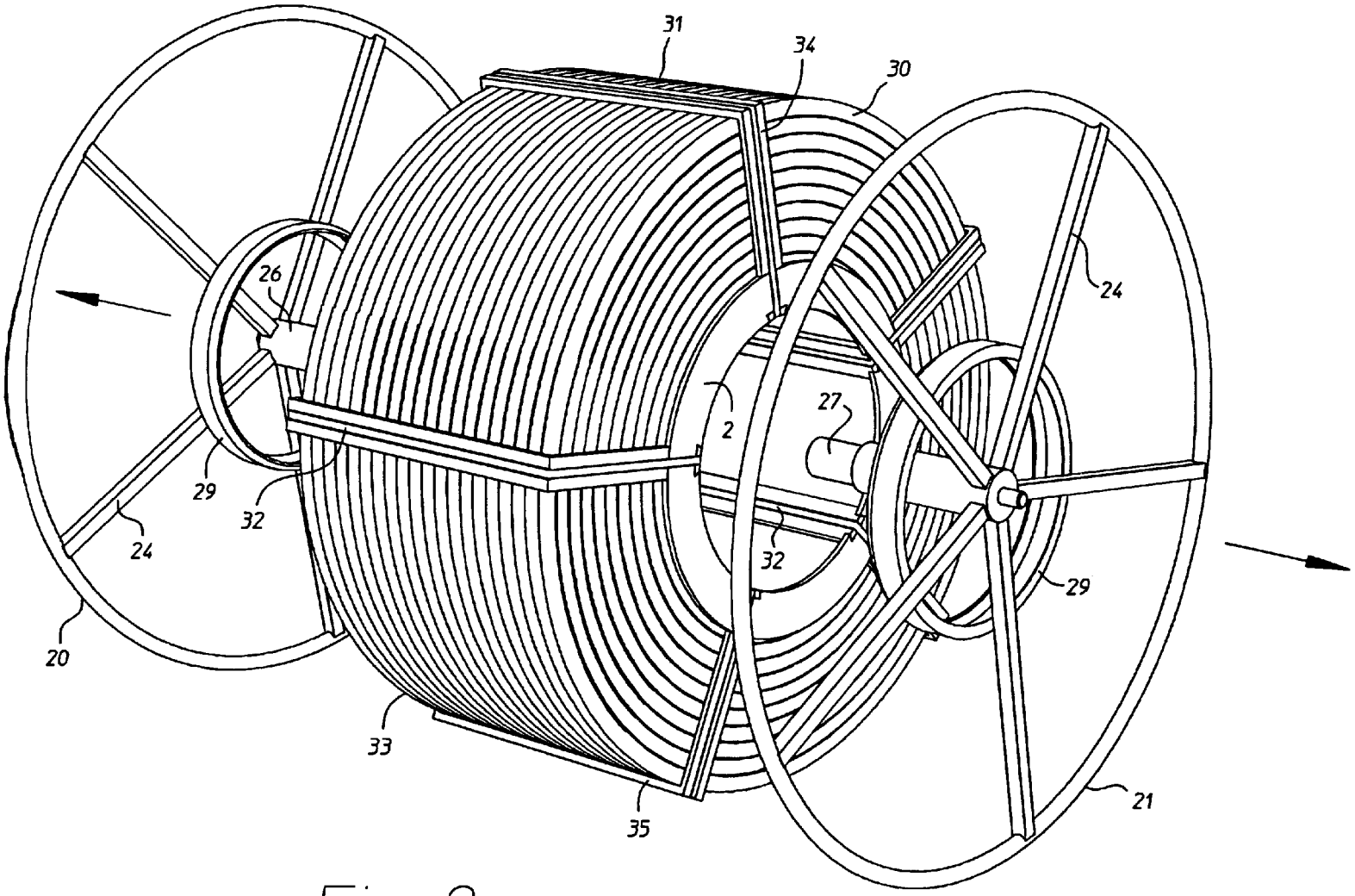
Figure 10:
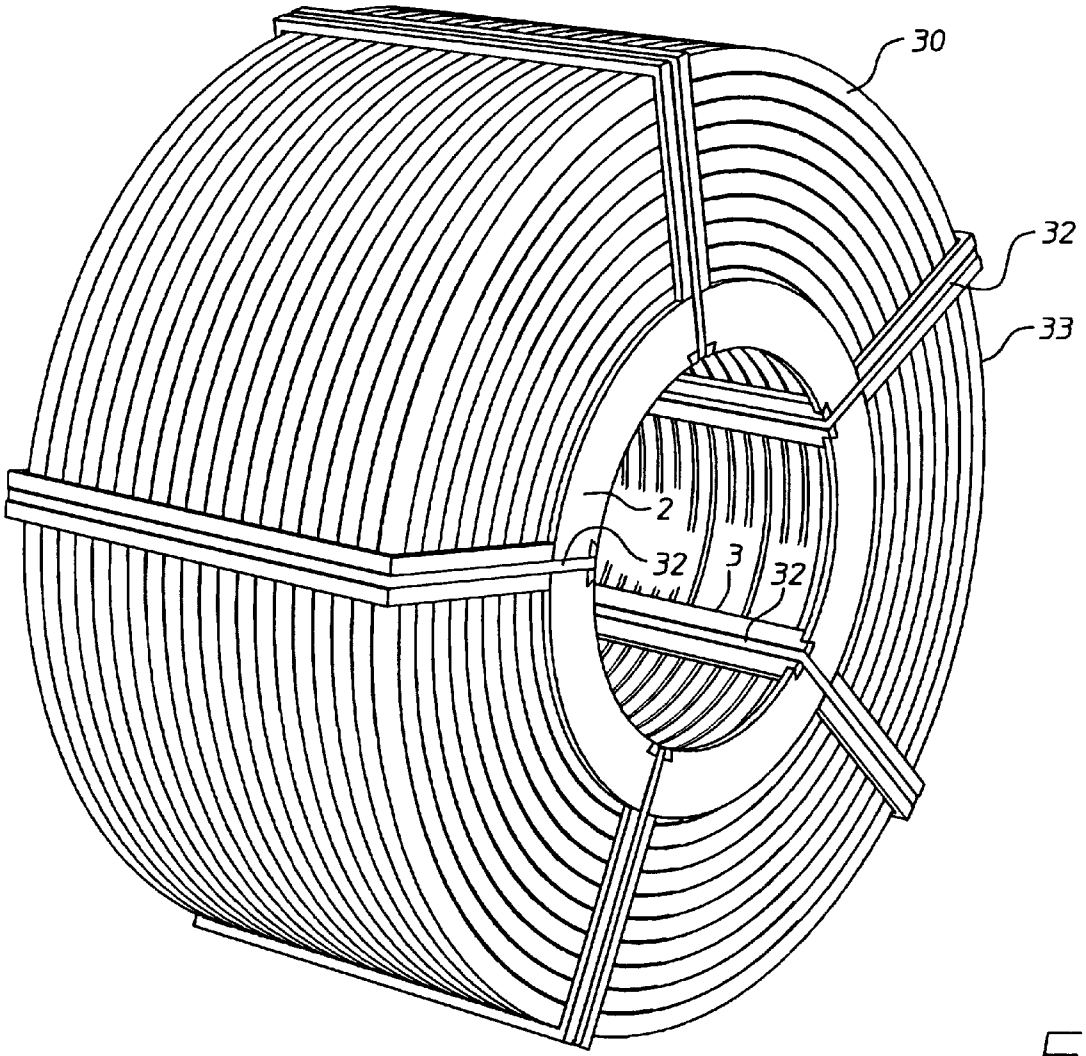

FIG. 5 shows a tool to be mounted on a core according to FIG. 1 in order to form a rotatable unit, as shown in more detail in FIG. 6. The tool consists of two circular, wheel-like, form-stable support rings 20, 21 of metal, such as steel or aluminium, and a connecting member for securing the support rings 20, 21 in relation to each other. Each support ring 20, 21 comprises an outer ring part 22 of a tube, a hub 23 and a plurality of spokes 24 supporting and centering the hub 23. In the embodiment shown the hub 23 has an outwardly turned axle bar 25 and said connecting member is formed by two opposing shaft parts 26, 27 protruding from the inner sides of the hub 23 to be brought into engagement with each other to form an axis of rotation 28. Each support ring 20, 21 is also provided on its inner side with a centering element 29 which is concentric with the axis of rotation and has a predetermined radius. In the embodiment shown the centering element 29 consists of an endless ring with an external cylindrical surface having a radius corresponding to the radius of the support surface 7 of the end ring 1, 2 for engagement with each other without clearance. The shaft parts 26, 27 are locked together by a suitable locking member (not shown). The support rings 20, 21 are so aligned in relation to the core that each spoke 24 is situated between, suitably centrally between, the tenons 9, 10 of two adjacent support elements 3. The finished, rotatable unit, shown in more detail in FIG. 6, is then placed in a coiling machine (not shown) for a predetermined length of hosing 30 to be wound on in order to obtain a coil 31, as shown in more detail in FIG. 7. As can be seen, the hosing 30 will abut the inner sides of the end rings 1, 2 and the inner side of the spokes 24. The coil 31 obtained is then anchored to the core with the aid of a plurality of straps 32 which can easily be passed through the grooves 17 on the inner sides 14 of the support elements 3 since they are open and thus accessible on both sides of the centering ring 29 of the support ring 20, 21 and radially outside. To protect the coil 31 protective elements 34, 35 are placed at the sides of the coil and across this where the straps 32 are arranged. When the straps 32 have been tightened and secured in order to obtain an endless joint as shown in FIG. 8, the support rings 20, 21 are disconnected from each other and removed from the finished parcel 33 as illustrated in FIGS. 9 and 10 and the finished parcel 33 is ready for delivery to the use site where a substantially similar tool, comprising two support rings with centering elements and connecting means, is available to be assembled with the parcel 33 in order once more to obtain a rotatable unit to be placed in an unwinding equipment. After cutting and removing the straps 32, the hosing 30 can be pulled out, leaving the core which can be partially or fully burn up on site, depending on whether it contains any re-usable parts, e.g. support elements 3 of aluminium.

I claim:

1. A core of a rotatable unit for manufacturing a coil of a continuous flexible object which envelops the core, said core comprising:

first and second flat substantially parallel end rings each having an inner circular concentric support surface defining a central substantially circular opening;

a plurality of recesses in said inner support surface in open communication with said central opening;

a plurality of longitudinal support elements, of substantially equal length, each having first and second substantially parallel ends, and outer and inner sides;

said support elements extending substantially axially between said end rings with said ends of each of said longitudinal elements engaging said rings at a said recesses, and said support elements maintaining said end rings substantially parallel to each other; and wherein said support elements are circumferentially spaced from each other around said end rings, and wherein the number of said plurality of recesses is the same as the number of said plurality of support elements.

2. A core as recited in claim 1 wherein said support elements are substantially uniformly spaced from each other around said end rings.

3. A core as recited in claim 2 wherein said support elements are spaced from each other around said end rings in a manner such that said support elements cover between 10–70% of the circumferential extent of said end rings.

4. A core as recited in claim 3 further comprising a strap-receiving groove formed in said inner side of each of said support elements.

5. A core as recited in claim 1 wherein said plurality of support elements comprises five support elements.

6. A core as recited in claim 1 further comprising a strap-receiving groove formed in said inner side of each of said support elements.

7. A core as recited in claim 1 wherein said support elements are spaced from each other around said end rings in a manner such that said support elements cover between 10–60% of the circumferential extent of said end rings.

8. A core as recited in claim 1 wherein said ends of said support elements are tenons, each being inwardly defined by one or two transverse support surfaces positions to form axial stops for said end rings, and each having a length corresponding to the thickness of the end ring with which it cooperates.

9. A core as recited in claim 8 wherein said recesses in said end rings are dovetail shaped as seen from the side of the end ring in which they are provided, and wherein said tenons have a cross-sectional shape corresponding to said recesses.

10. A core as recited in claim 1 wherein each of said plurality of support elements has approximately the same size cross-section and circumferential extent.

11. A core as recited in claim 10 wherein said support elements are substantially uniformly spaced from each other around said end rings.

12. A core as recited in claim 1 wherein said central opening has a diameter of at least 0.8 meters.

13. A core as recited in claim 1 wherein said support elements and said end rings are maintained in engagement with each other by friction joints, without the use of glue, nails, or other similar securing means.

14. A core as recited in claim 1 wherein said support elements are aluminum and are adapted to be reusable, and said end rings are of wood fiber material and are adapted to be disposable.

15. A core as recited in claim 1 wherein said support elements and said end rings are of wood or wood fiber material.

16. A parcel comprising a core and hose, flexible tubing, rope, wire, ribbon, or cable packaged thereon, comprising:

a core, said core comprising: first and second flat substantially parallel end rings each having an inner circular concentric support surface defining a central substantially circular opening; a plurality of recesses in said inner support surface in open communication with said central opening; a plurality of longitudinal support elements, of substantially equal length, each having first and second substantially parallel ends, and outer and inner sides; said support elements extending substantially axially between said end rings with said ends of each of said longitudinal elements engaging said rings at a said recesses, and said support elements maintaining said end rings substantially parallel to each other; and a strap-receiving groove formed in said inner side of each of said support elements;

hose, flexible tubing, rope, wire, ribbon, or cable extending circumferentially around and surrounding said support elements, and disposed between said end rings and extending radially outwardly from said core; and a plurality of straps extending through said strap-receiving grooves, and around said hose, flexible tubing, rope, wire, ribbon, or cable, and holding said hose, flexible tubing, rope, wire, ribbon, or cable onto said core.

17. A package as recited in claim 16 wherein said support elements are substantially uniformly circumferentially spaced from each other around said end rings in a manner such that said support elements cover between 10–70% of the circumferential extent of said end rings.

18. A method of manufacturing a coil of hose, flexible tubing, rope, wire, ribbon, or cable surrounding a core, using first and second flat substantially parallel end rings each having an inner circular concentric support surface defining a central substantially circular opening; and a plurality of recesses in the inner support surface in open communication with the central opening; and a plurality of longitudinal support elements, of substantially equal length, each having first and second substantially parallel ends, and outer and inner sides, said method comprising substantially sequentially:

(a) bringing the support element ends into engagement with the first and second end rings at recesses in the end rings so that the ends of the support elements substantially coincide with the outer sides of the end rings and the inner sides of the support elements substantially coincide with the circular support surface, and so that the support elements are circumferentially spaced from each other;

(b) clamping the core between two substantially parallel support rings and so that a centering element of each support ring extends into the central opening;

(c) attaching the hose, flexible tubing, rope, or cable to the core;

(d) rotating the support rings and centering element so that the hose, flexible tubing, rope, wire, ribbon, or cable is wound around the core to form a coil of hose, flexible tubing, rope, wire, ribbon, or cable extending radially outwardly from the core, and contained by the support rings;

(e) cutting the hose, flexible tubing, rope, wire, ribbon, or cable;

(f) encircling a plurality of portions of the coil, the support elements, and corresponding portions of the end rings with a plurality of straps which hold the coil to the core; and (g) removing the supporting rings and centering element away from the core so that the coil, core, and straps provide an integral self-supporting package.

19. A method as recited in claim 18 wherein the support elements have grooves formed in the inner sides thereof which open to the exterior of the end rings; and wherein (f) is practiced by threading the straps through the grooves from the exterior of the end rings while the supporting rings and centering element operatively engage the core.

20. A method as recited in claim 19 wherein (f) is practiced for each support element.

21. A method as recited in claim 18 wherein the support elements are made of aluminum and the end rings are made of wood fiber material; and wherein said method further comprises: severing the straps; uncoiling the hose, flexible tubing, rope, or cable from core; disposing of the end rings so that they are only used once in a method practicing (a)–(g); and reusing the support elements with new end rings to repeat (a)–(g).

* * * * *